US010500429B1

(12) United States Patent
Bagumyan et al.

(10) Patent No.: US 10,500,429 B1
(45) Date of Patent: Dec. 10, 2019

(54) SAFETY AIRBAG SYSTEM

(71) Applicants: Sarmen Bagumyan, Glendale, CA (US); Arthur Bagumyan, Glendale, CA (US); Andranik Andy Bagumyan, Glendale, CA (US)

(72) Inventors: Sarmen Bagumyan, Glendale, CA (US); Arthur Bagumyan, Glendale, CA (US); Andranik Andy Bagumyan, Glendale, CA (US)

( * ) Notice: Subject to any disclaimer, the term of this patent is extended or adjusted under 35 U.S.C. 154(b) by 0 days.

(21) Appl. No.: 16/006,538

(22) Filed: Jun. 12, 2018

Related U.S. Application Data

(63) Continuation-in-part of application No. 15/454,571, filed on Mar. 9, 2017, now abandoned.

(51) Int. Cl.
*A63B 6/02* (2006.01)
*A63G 31/12* (2006.01)
*A63G 31/00* (2006.01)

(52) U.S. Cl.
CPC ..... *A63B 6/02* (2013.01); *A63G 31/12* (2013.01); *A63G 2031/002* (2013.01)

(58) Field of Classification Search
CPC .. A63B 6/02; A63B 1/22; A63G 31/12; A63G 2031/002
See application file for complete search history.

(56) References Cited

U.S. PATENT DOCUMENTS 1,985,432 A 12/1934 Tucker et al.
2,906,366 A * 9/1959 Mapes ..... A62B 1/22 182/139
3,310,818 A 3/1967 Fischer
3,603,430 A * 9/1971 Kendall ..... F16K 17/36 137/512.15
3,674,019 A 7/1972 Grant
3,851,730 A 12/1974 Scurlock
4,120,061 A 10/1978 Clark
5,598,593 A 2/1997 Wolfe
7,269,866 B2 9/2007 Liu
7,357,728 B2 4/2008 Osler-Weppenaar
7,530,128 B2 5/2009 Wu
7,591,036 B2 9/2009 Lin et al.
8,973,193 B2 3/2015 Codos
2003/0024050 A1 2/2003 Boso et al.
2005/0081299 A1* 4/2005 Torres ..... A47C 27/081 5/710

(Continued)

FOREIGN PATENT DOCUMENTS

WO WO2010/112953 10/2010

*Primary Examiner* — Alvin C Chin-Shue

(74) *Attorney, Agent, or Firm* — Eric Karich; Karich & Associates

(57) ABSTRACT

An airbag system having a base air mattress, a top air mattress, and a plurality of tubular posts positioned between the base air mattress and the top air mattress in a generally vertical orientation so that the top air mattress is supported upon the base air mattress. A plurality of breather holes are provided in either the top air mattress or the base air mattress, wherein each of the tubular posts is sealably mounted around at least one of the plurality of breather holes. The tubular posts all have a common diameter, and the tubular posts are separated from each other by a distance that is greater than the common diameter of the tubular posts.

12 Claims, 8 Drawing Sheets

(56) References Cited

U.S. PATENT DOCUMENTS

| | | | | |
|---|---|---|---|---|
| 2006/0021133 | A1* | 2/2006 | Davis | A61G 7/1028 5/81.1 R |
| 2006/0080781 | A1* | 4/2006 | Zheng | A47C 4/54 5/681 |
| 2016/0101300 | A1* | 4/2016 | Gray | A62B 1/22 182/137 |

* cited by examiner

SAFETY AIRBAG SYSTEM

CROSS-REFERENCE TO RELATED APPLICATIONS

This application for a utility patent is a continuation-in-part of a previously filed utility patent, still pending, having the application Ser. No. 15/454,571, filed Mar. 9, 2017.

BACKGROUND

1. Technical Field

The present disclosure generally relates to an airbag, and more particularly to a safety airbag system which includes two inflatable air mattresses which together sandwich a plurality of inflatable tubes therebetween for absorbing the impact of a person or object at the end of a fall or jump from an elevated height.

2. Related Art

Safety airbag systems for absorbing the impact of people free falling or jumping from elevated heights are regularly employed in a wide range of applications (e.g., extreme sports, amusement, circuses, etc.).

One of the problems with large air-filled air mattresses used in the prior art is that it takes a considerable amount of time for these air mattresses to re-inflate after a use. In applications, such as amusement or fun park environments, where aerobatic stunts are performed continuously in short intervals, the time it takes to re-inflate the airbag is important.

A potential safety hazard present in existing safety airbags is the use a single air mattress. In the event that the airbag is ripped or otherwise damaged during use, the airbag could quickly deflate, and the person using the device could possibly be injured or killed when the airbag fails to cushion his or her fall.

Inflatable airbag safety devices currently exist that incorporate both an airbag, and also a plurality of collapsible pop-up tubes (sometimes called "crumple tubes") to cushion the free fall of an individual. For example, U.S. Pat. No. 7,357,728 discloses one such device. Such devices sometimes use a top sheet to serve as the landing surface, and the person is cushioned first by the tubes, and then by the underlying airbag.

A similar example is shown in U.S. Pat. Application No. 2016/0101300, which teaches a safety airbag system that includes a single airbag, and a plurality of the "crumple tubes" on top for enabling rapid re-inflation of the system following use. A sheet is positioned over the tops of the "crumple" tubes, and fastened to each of the tubes. Neither of these devices, however, include a redundant second airbag positioned over the tops of the "crumple" tubes.

A second airbag not only increases the safety of the device through redundancy, it also serves to distribute the impact of the person across multiple tubular posits in a safer manner, which still maintaining the ability of the system to quickly re-inflate.

Accordingly, a need therefore exists for an airbag that has redundant air mattresses for added safety, and also includes a middle layer of support tubes which enable rapid re-inflation of the system.

SUMMARY

The present invention provides an airbag system having a base air mattress, a top air mattress, and a plurality of tubular posts positioned between the base air mattress and the top air mattress in a generally vertical orientation so that the top air mattress is supported upon the base air mattress. A plurality of breather holes are provided in either the top air mattress or the base air mattress, wherein each of the tubular posts is sealably mounted around at least one of the plurality of breather holes. The tubular posts all have a common diameter, and the tubular posts are separated from each other by a distance that is greater than the common diameter of the tubular posts.

Another objective is to provide an airbag system that provides a superior landing surface upon which a person or object may fall.

Another objective is to provide an airbag system that re-inflates faster than most prior art air bags following use.

A further objective is to provide an airbag system that includes redundant inflatable compartments, to provide superior safety in the event of damage to one of the inflatable air mattress.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The present disclosure may be better understood by referring to the following figures.

DETAILED DESCRIPTION

Figure 1:
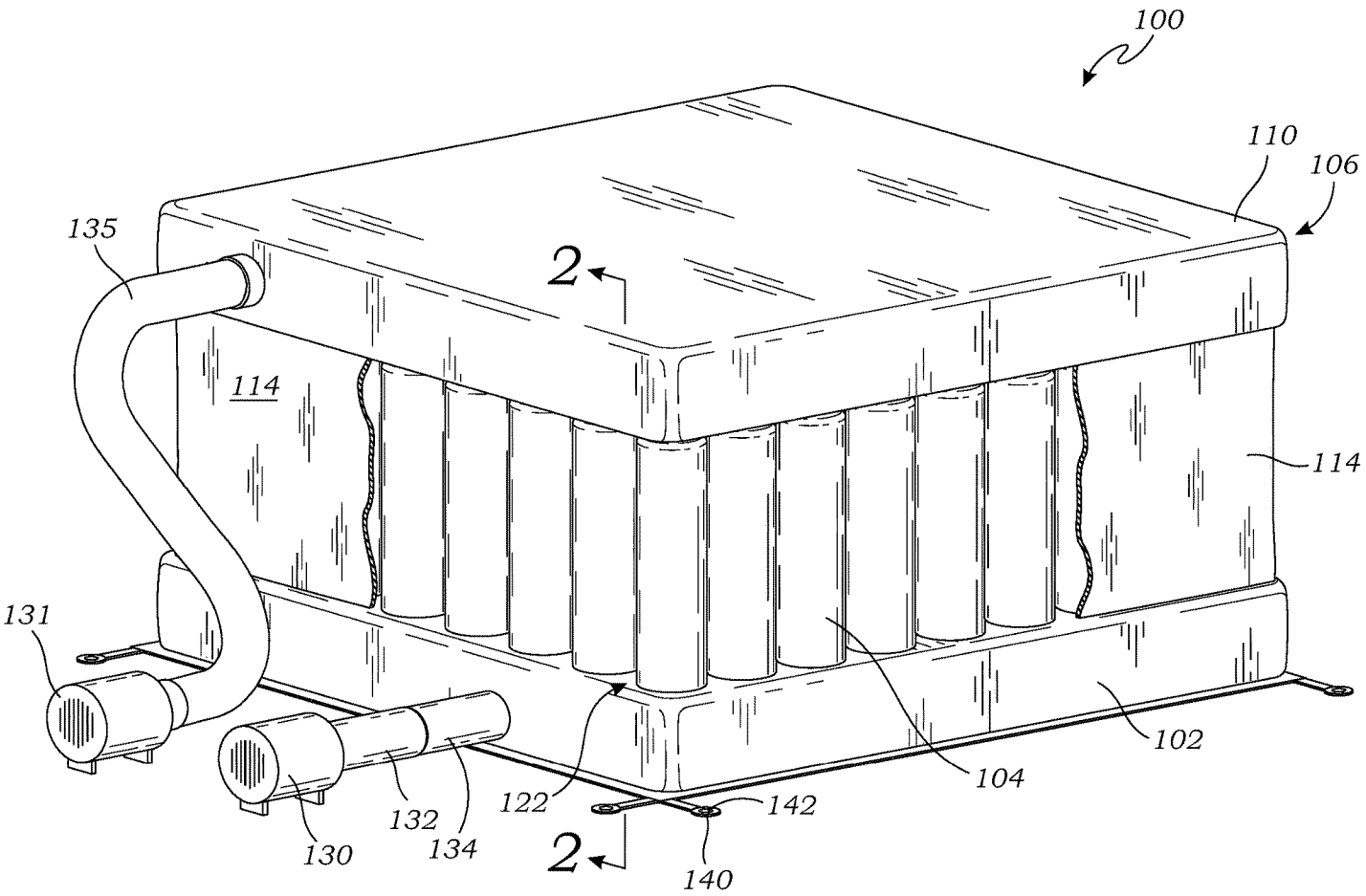
FIG. 1 is a perspective view of one embodiment of a safety airbag system of the present disclosure.
Figure 2:
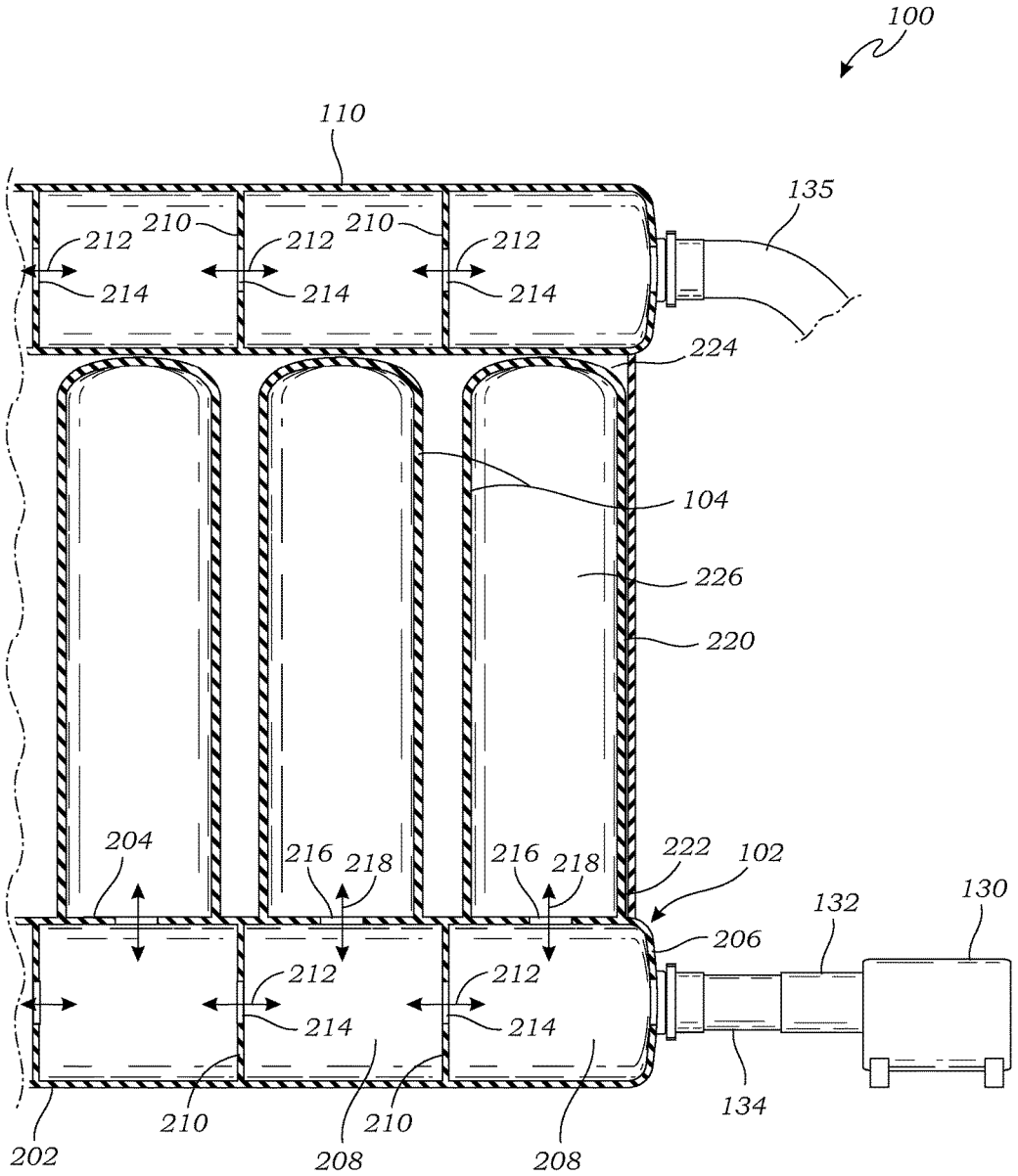
FIG. 2 is a partial cross-sectional view of the safety airbag system illustrated in FIG. 1, taken across line 2-2, illustrating base and top air mattresses separated by tubular posts, wherein the tubular posts receive airflow from the base air mattress.

FIG. 1 is a perspective view of one embodiment of a safety airbag system 100 of the present disclosure, which is adapted for cushioning the free fall of an individual (or other type of object) from an elevated height. FIG. 2 is a partial cross-sectional view of the safety air bag system 100 illustrated in FIG. 1, taken across line 2-2. As shown in FIGS.

1-2, the safety airbag system 100 includes an inflatable base air mattress 102, a plurality of tubular posts 104 (sometimes called "crumple tubes"), and a top air mattress 108, which, collectively, form an inflatable structure 106.

In the embodiment of FIGS. 1 and 2, the base air mattress 102 is an inflatable bladder having a bottom wall 202, a top wall 204, and a peripheral sidewall 206. The bottom wall 202, the top wall 204, and the sidewall 206 together form an inflatable air chamber 208. In this embodiment, the base air mattress 102 is a generally planar construction that is adapted to rest on the ground (e.g., earth, floor or other support surface). In the present embodiment, the base air mattress 102 is cuboid in shape, although other suitable shapes may also be used. The sidewall 206 may be attached, for example by sewing, stitching, welding, radio-frequency (RF) welding, hot-air welding, gluing or other means known in the art, between the top wall 204 and the bottom wall 202. It may be attached in such a way that permits a limited but continuous amount of air to leak from the air chamber 208 when the base air mattress 102 and crumple tubes 104 are fully inflated, to prevent "ballooning" or over-inflation of the inflatable structure 106, as is known in the art.

The air chamber 208 of the base air mattress 102 may be separated into sections by one or more baffles 210, which act as tensioning structures that shape and maintain the integrity of the base air mattress 102 when the air chamber 208 is pressurized, so that the top wall 204 of the air mattress lies, for example, relatively flat. Air communication between the sections, denoted by arrows 212, is permitted by one or more vents 214 formed in each baffle 210.

In this embodiment, the plurality of tubular posts 104 are positioned between the base air mattress 102 and the top air mattress 110 in a generally vertical orientation so that the top air mattress 110 is supported upon the base air mattress 102, and the plurality of tubular posts 104 support the top air mattress 110 a distance above the base air mattress 102. The system 100 includes breather holes 216 in either the top air mattress 110 or the base air mattress 102, such that each of the tubular posts 104 is sealably mounted around one of the breather holes 216 to permit airflow from either the base air mattress 102 or the top air mattress 110 into the corresponding tubular post 216. In one embodiment, each of the tubular posts 104 is sealably mounted around a single one of the breather holes 216 (of either the top air mattress 110, the base air mattress 102, or a single one of each). In another embodiment, more than one of the breather holes 216 may be included.

In the embodiment of FIG. 2, the breather holes 216 are formed in the top wall 204 of the base air mattress 102, to permit airflow, denoted as arrows 218, to and from the crumple tubes 104. The breather holes 216 further connect the base air mattress 102 with the crumple tubes 104 such that air pressure within the base air mattress 102 maintains the crumple tubes 104 in an extended (i.e., inflated) position. The breather holes 216 may be constructed to any size or shape, depending on the desired application, to provide a soft landing for a person landing on the inflatable structure 106 via the crumple tubes 104.

Figure 3:
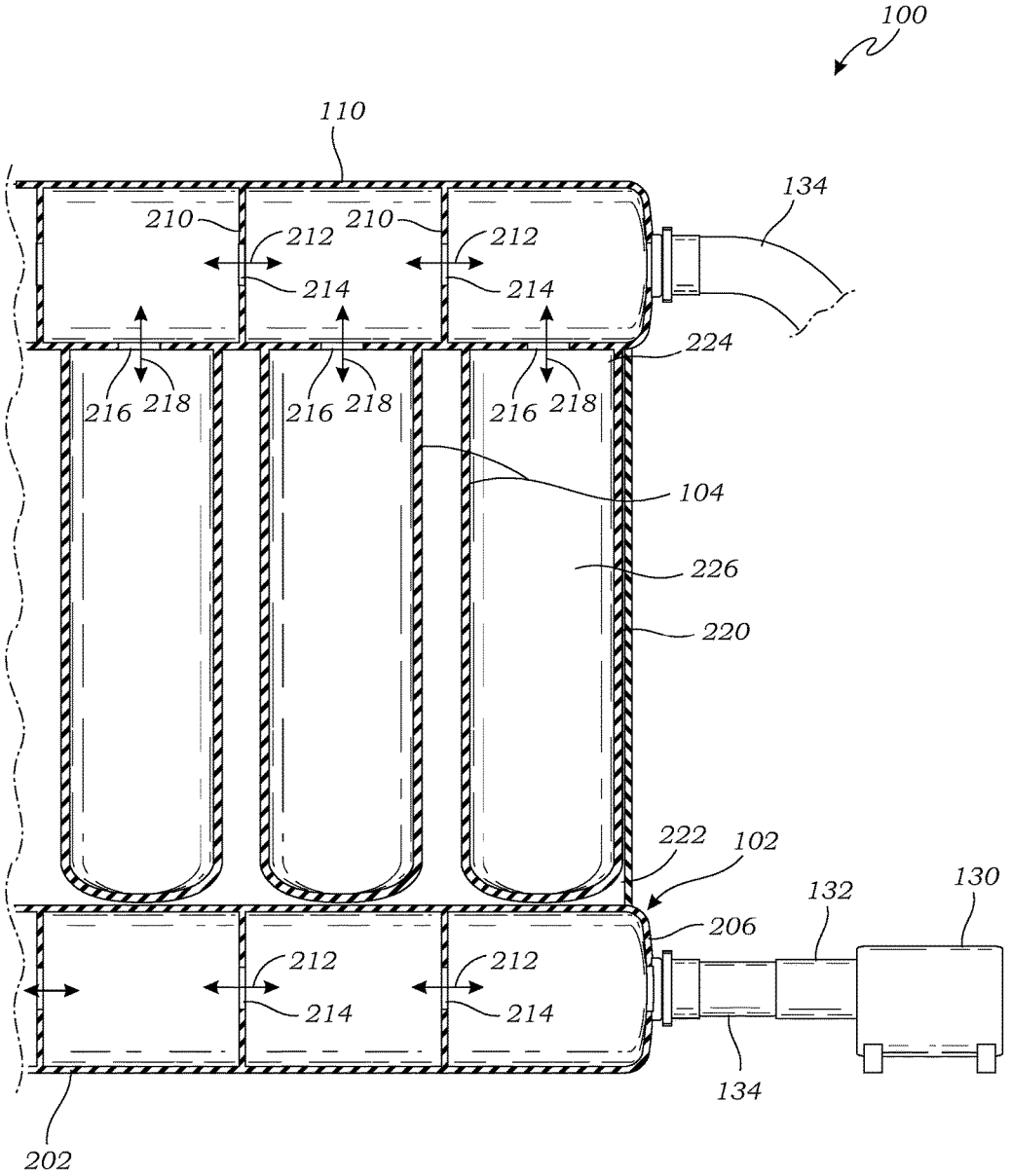
FIG. 3 is a partial cross-sectional view, similar to FIG. 2, of an alternative embodiment of the safety airbag system wherein the tubular posts receive airflow from the top air mattress.
Figure 4:
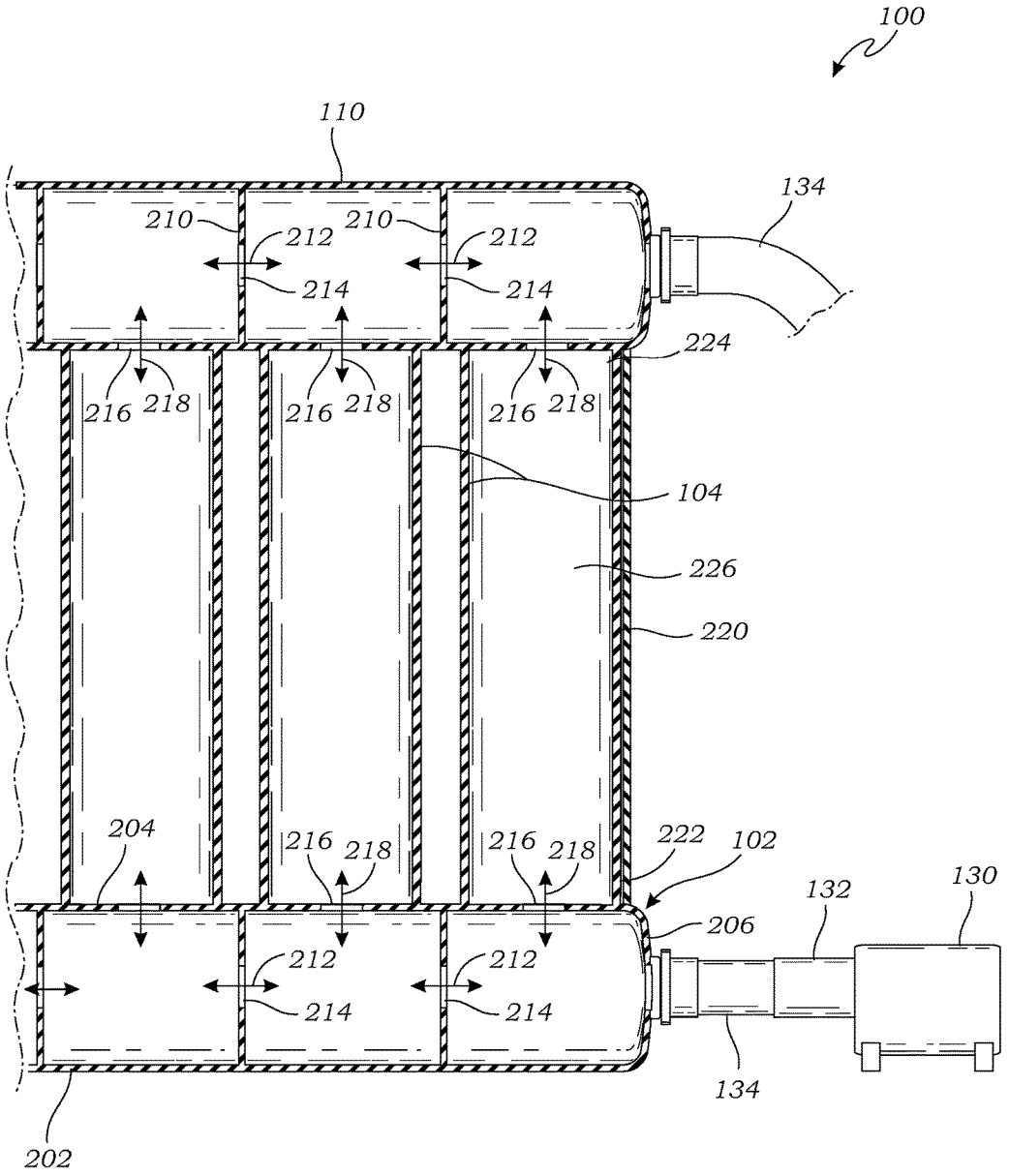
FIG. 4 is a partial cross-sectional view, similar to FIG. 2, of another alternative embodiment of the safety airbag system, wherein the tubular posts receive airflow from both the base and top air mattresses.

In this embodiment, each of the tubular posts 104 is an inflatable airbag that includes an elongated annular tube wall 220. The tubular post may include an open end 222 and a closed end 224. The open end 222 may be sewn or otherwise attached to the air mattress. The closed end 224 may be closed with a domed top portion, as shown in this embodiment, or it may alternatively be sewn to the adjacent air mattress (as shown in FIGS. 2-4). The tube wall 220 defines an interior cavity 226 for receiving air. The tubular posts 104 are coupled to the base air mattress 102 at the open end 222, over the breather holes 216 formed in the top wall 204 of the base air mattress 102. The tubular posts 104 may be coupled to the base air mattress 102 using any suitable coupling technique, such as sewing, high-frequency coupling, hot coupling (e.g., heat sealing, melting, welding), or adhering (e.g., gluing), for example.

In some implementations, the tubular posts 104 may be arranged in any manner desired by one skilled in the art. They may also be of similar height, as shown, or they may be of differing heights, as desired by one skilled in the art. The tubular posts 104, as illustrated in FIG. 2, may comprise a circular cross section. However, in other implementations, the crumple tube 104 cross section may comprise other shapes. While the air pressure tends to form the tops of the tubular posts 104 into a semi-circular shape, various shapes may be attained by means well known in the art.

The top air mattress 110 is mounted over, and may abut or be attached to a top portion of the tubular posts 104. The top air mattress 110 provides an air-cushioned landing structure for a person falling from an elevated height. The top air mattress 110 further provides redundancy to the system 100, in the event that the base air mattress 102 is torn or otherwise damaged and loses air pressure. The top air mattress 110 may be of similar general construction to the base air mattress 102, as described in greater detail above; or it may alternatively have a different construction as designed by one skilled in the art consistent with the present disclosure.

The base air mattress 102, tubular posts 104, and top cover 110 may be constructed of any suitable material known in the art. In the preferred embodiment, the material is relatively flexible, and is airtight or semi-permeable, such as is known in the art for such inflatable structures. Non-limiting examples commonly used include canvas, nylon, plastic, polyvinyl chloride (PVC), thermoplastic rubber (TPR), ethylene vinyl acetate (EVA), thermoplastic polyurethane elastomer (TPU), neoprene-coated fabric or other suitable materials known in the art. The disclosed airbag system 100 may be useful as a safety device in any field, including but not limited to entertainment, sports, recreation, amusement, fall-arrest safety, fire rescue, and any other field in which persons may be working, performing, playing, sliding, or otherwise standing on and have the potential to fall from elevated structures.

FIG. 3 is a partial cross-sectional view, similar to FIG. 2, of an alternative embodiment of the safety air bag system 100. In the embodiment of FIG. 3, the breather holes 216 are formed in the top bag 110 rather than the base air mattress 102. As described above, the breather holes 216 permit airflow to and from the tubular posts 104. In an alternative embodiment, the breather holes 216 may alternate between top and base air mattresses, but the top air mattress 110 and the base air mattress 102 are not in pressurized fluid communication with each other in this embodiment. In one embodiment, the plurality of breather holes 216 in the top air mattress 110, and/or the plurality of breather holes 216 in the base air mattress 102, are arranges such that each of the tubular posts 104 is sealably mounted around a single one of the breather holes 216 (of the base air mattress 102 and/or the top air mattress 110), to permit airflow from air mattress(es) and the corresponding tubular post 104, but there is no airflow between the tubular posts 104 except via the base air mattress 102 and/or the top air mattress 110. In other embodiments, more than one breather hole 216 is included.

Returning to FIG. 1, the base air mattress 102 may be inflated by an air blower 130, and the top air mattress 110 may be inflated by a second air blower 131. The air blower 130 is described herein and the second air blower 131 is understood to be of similar or equivalent construction, and connected to the top air mattress 110 via conduit 135. The air blower 130 may include an outlet 132 for passing air to the inflatable structure 106 through an inlet tube 134 coupled to the base air mattress 102. As discussed above, one of the air mattresses (base, top, or both, as discussed below) further functions to inflate the tubes 104, depending upon the locations of the breather holes. The size (i.e., horsepower or rpm) of the air blower 130 may vary depending on the application. For example, a 1 hp air blower may be used to inflate the inflatable structure 106 and blow constant air into the base air mattress 102 and tubular posts 104. In other examples, a ½ hp blower may be used, for example, for a very small air mattress, or 2 lip blower may be used, for example, for a large air mattress employed to cushion the end of an extreme snowboarder's jump, trick or stunt.

FIG. 4 is a partial cross-sectional view, similar to FIG. 2, of another alternative embodiment of the safety airbag system 100. As shown in FIG. 4, in this embodiment, the tubular posts 104 receive airflow from both the base and top air mattresses 102 and 110.

Figure 5:
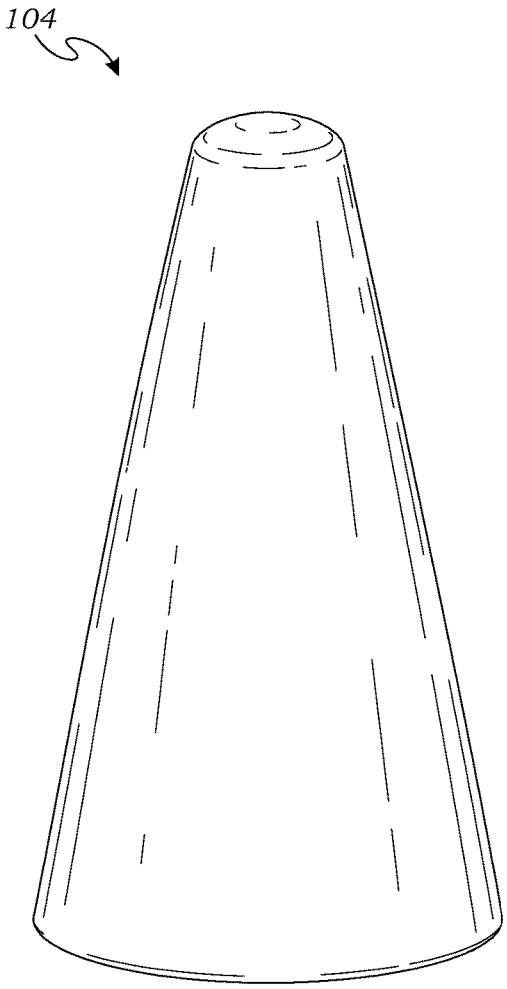
FIG. 5 is a perspective view of an alternative embodiment of one of the tubular posts, wherein the tubular post has a conical shape.
Figure 6:
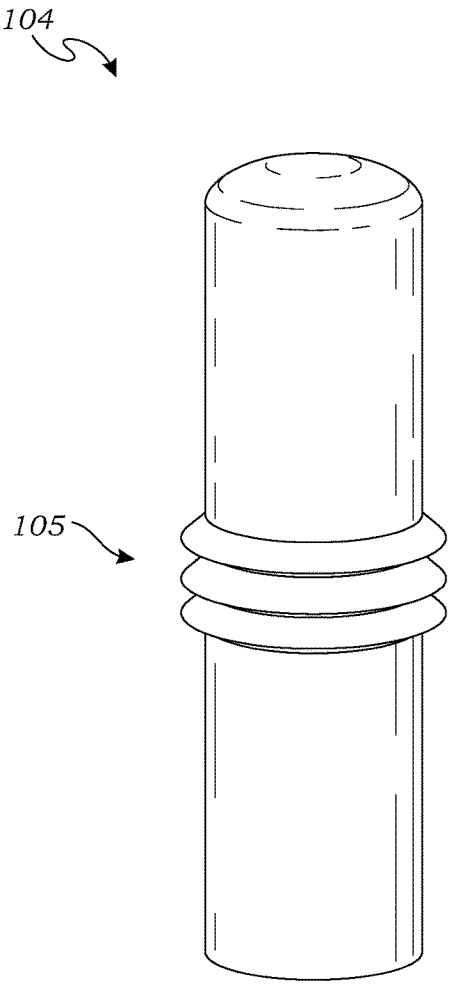
FIG. 6 is a perspective view of another alternative embodiment of one of the tubular posts, wherein the tubular post has an accordion section.

FIG. 5 is a perspective view of an alternative embodiment of one of the tubular posts 104, wherein the tubular post 104 has a conical shape. While some embodiments of the tubular shape of these posts 104 are illustrated, the scope of the present invention further includes yet other shapes that may be determined by those skilled in the art. FIG. 6 is a perspective view of another alternative embodiment of one of the tubular posts 104, wherein the tubular post 104 has an accordion section 105. The accordion section 105 functions to facilitate the correct collapse of the tubular post 104 during use, and may provide superior performance in some circumstances.

While the example implementations of the present disclosure have been described herein with reference to providing safety for human beings, the present disclosure may be employed for the safety of any subject, including animals, or any object capable of falling from a height. In general, terms such as "coupled to," and "configured for coupling to" and "secured to" (for example, a first component is "coupled to" or "is configured for coupling to" or is "secured to" a second component), or "communicate" (for example, a first component "communicates with" or "is in communication with" a second component) are used herein to indicate a structural, functional, mechanical, and/or fluidic relationship between two or more components (or elements, features, or the like). As such, the fact that one component is said to couple to a second component is not intended to exclude the possibility that additional components may be present between, and/or operatively associated or engaged with, the first and second components.

Figure 7:
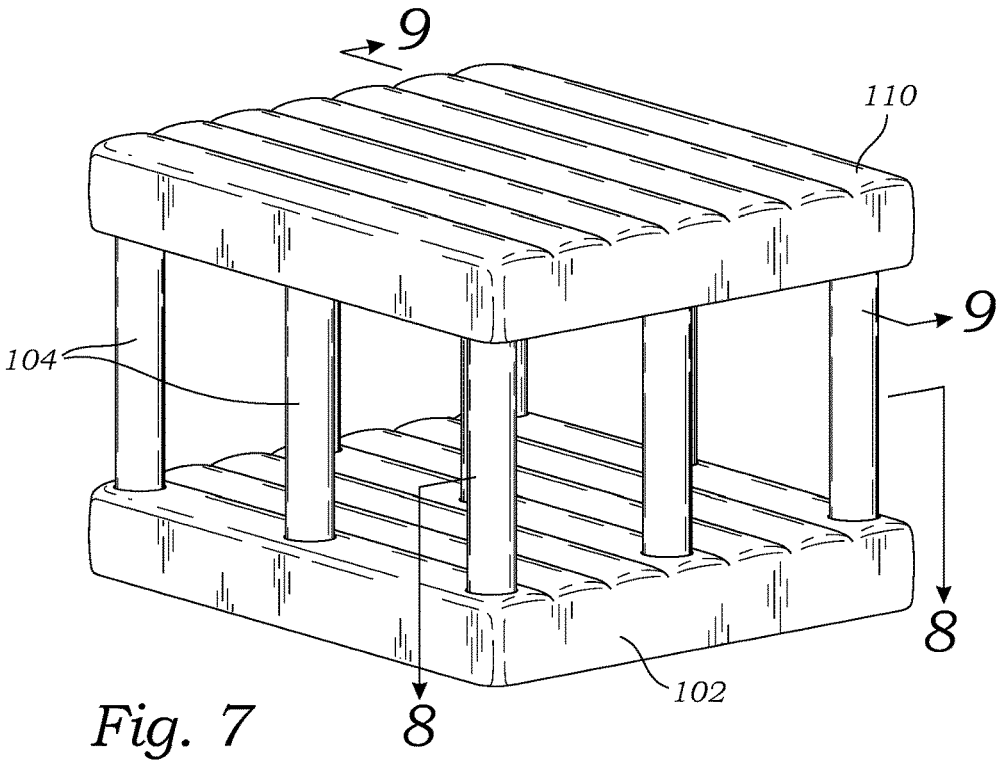
FIG. 7 is a perspective view of another alternative embodiment of the airbag system.
Figure 8:
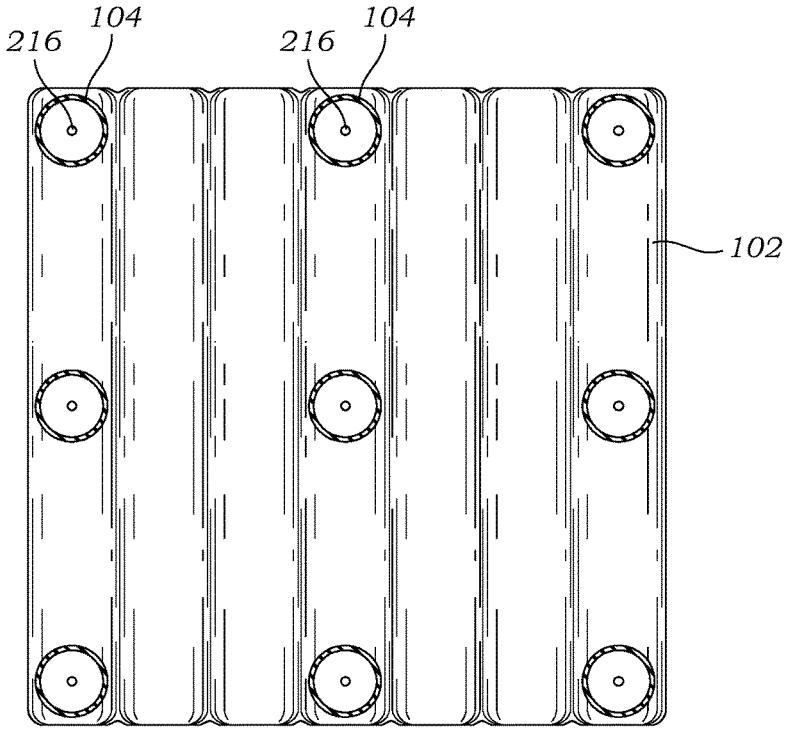
FIG. 8 is a sectional view thereof taken along line 8-8 in FIG. 7.
Figure 9:
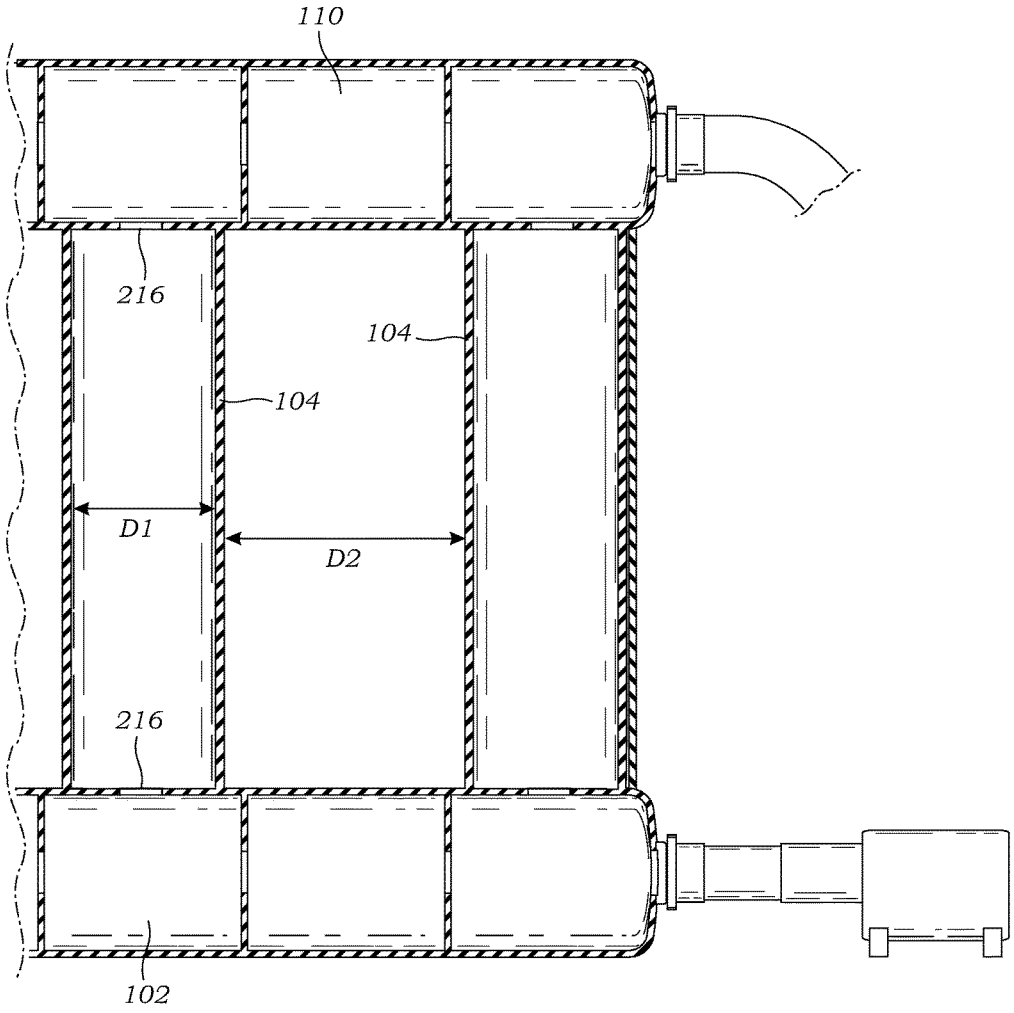
FIG. 9 is a portion of a sectional view thereof taken along line 9-9 in FIG. 7.

FIG. 7 is a perspective view of another alternative embodiment of the airbag system. FIG. 8 is a sectional view thereof taken along line 8-8 in FIG. 7. FIG. 9 is a portion of a sectional view thereof taken along line 9-9 in FIG. 7. As shown in FIGS. 7-9, in this embodiment there are a single one of the breather holes 216 in both the top air mattress 110 and the bottom air mattress 102. Furthermore, the tubular posts 104 all have a common diameter D1, and the tubular posts 102 are separated from each other by a distance D2 that is greater than the common diameter D1 of the tubular posts 104. In some embodiments, the distance D2 is more than twice that of the common diameter D1. This increased spacing enables the tubular posts 102 to function as a kind of spring between the air mattresses 102 and 110; however, these posts 102 require relatively little air volume, so they are able to refill and re-expand much more quickly than a prior art system. In one embodiment, the total volume of all of the tubular posts 102 is less than 10% of the volume of either one of the air mattresses 102 or 110. Especially in the embodiment wherein the breather holes 216 are present in both the top and bottom air mattresses 102 and 110, this enables the tubular posts 104 to refill very quickly given their very little volume relative to their height.

Figure 10:
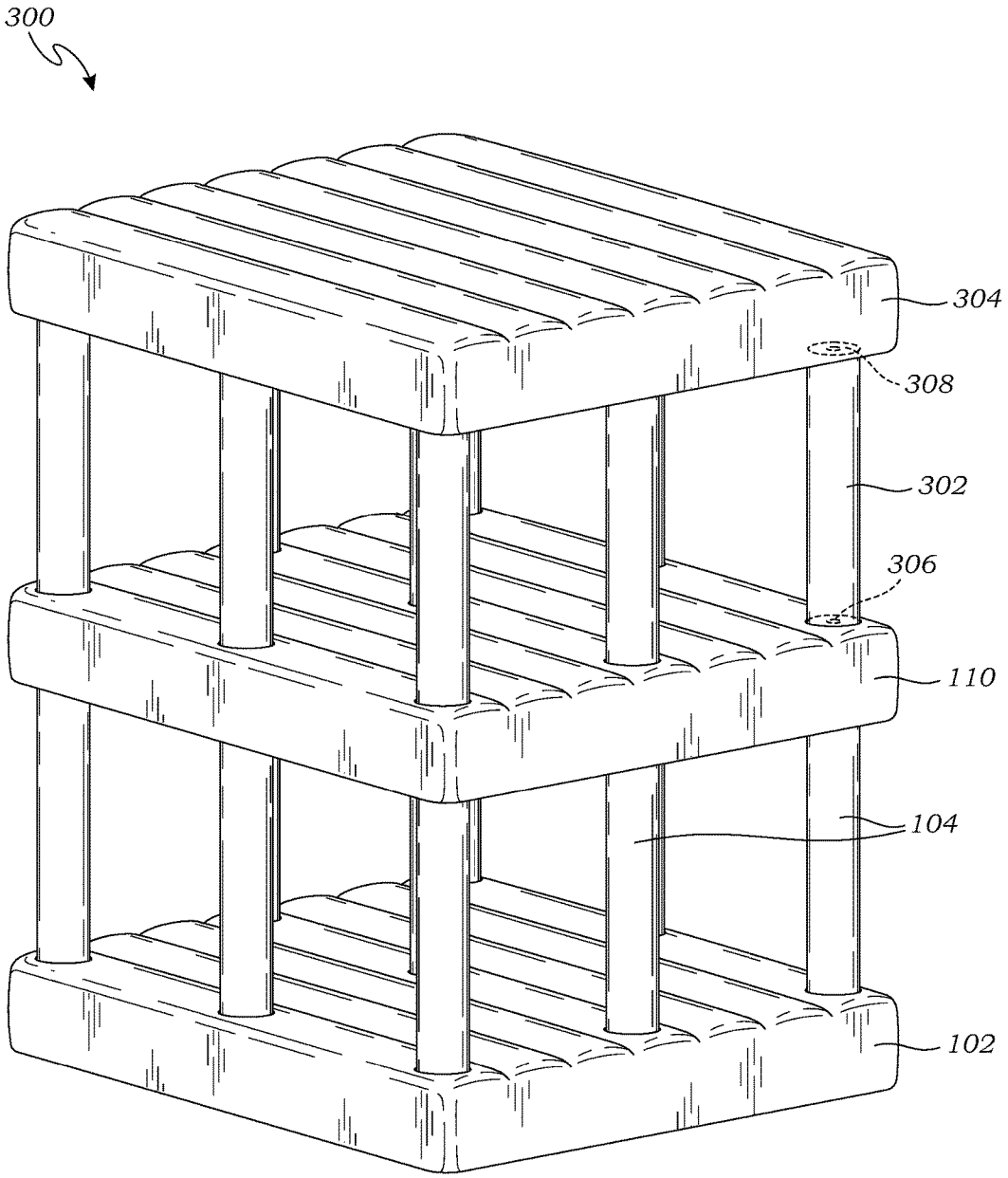
FIG. 10 is a perspective view of another alternative embodiment of the airbag system.

FIG. 10 is a perspective view of another alternative embodiment of the airbag system. As shown in FIG. 10, this embodiment is fairly similar to the prior systems, further comprising a third air mattress 304 operably supported upon the top air mattress 110 by a second plurality of tubular posts 302. In this embodiment, an additional arrangement of breather holes 306 are provided between the top air mattress 110 and the tubular posts 302, as well as further breather holes 308 allowing communication between the tubular posts 302 and the third air mattress 304. These limitations are generally similar to the embodiments described above, so the above discussion is incorporated by reference. This configuration provides an even greater amount of cushioning, while providing two layers of tubular posts 104 and 302 that can absorb impact, and they be quickly re-inflated.

As used in this application, the words "a," "an," and "one" are defined to include one or more of the referenced item unless specifically stated otherwise. The terms "approximately" and "about" are defined to mean +/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by the following claim.

What is claimed is:

1. An airbag system comprising:

a base air mattress capable of sustaining an air pressure;

a top air mattress capable of sustaining an air pressure;

a plurality of tubular posts positioned between the base air mattress and the top air mattress in a generally vertical orientation so that the top air mattress is supported upon the base air mattress; and a plurality of breather holes in the top air mattress and a plurality of breather holes in the base air mattress, wherein each of the tubular posts is sealably mounted around a single one of the breather holes of the base air mattress, and a single one of the breather holes of the top air mattress, to permit airflow from both the base air mattress and the top air mattress into the corresponding tubular post, but there is no airflow between the tubular posts except via the base air mattress and the top air mattress.

2. The airbag system of claim 1, wherein the tubular posts all have a common diameter, and the tubular posts are separated from each other by a distance that is greater than the common diameter of the tubular posts.

3. The airbag system of claim 1, wherein the tubular posts all have a common diameter, and the tubular posts are separated from each other by a distance that is greater than twice the common diameter of the tubular posts.

4. The airbag system of claim 1, further comprising an air blower operably connected to the base air mattress so that air from the air blower blows directly into the base air mattress, and a second air blower operably connected to the top air mattress so that air from the second air blower blows directly into the top air mattress.

5. The airbag system of claim 1, further comprising a third air mattress operably supported upon the top air mattress by a second plurality of tubular posts.

6. An airbag system comprising:

a base air mattress capable of sustaining an air pressure;

a top air mattress capable of sustaining an air pressure;

a plurality of tubular posts positioned between the base air mattress and the top air mattress in a generally vertical orientation so that the top air mattress is supported upon the base air mattress;

a plurality of breather holes in either the top air mattress or the base air mattress, wherein each of the tubular posts is sealably mounted around at least one of the plurality of breather holes; and wherein the tubular posts all have a common diameter, and the tubular posts are separated from each other by a distance that is greater than the common diameter of the tubular posts.

7. The airbag system of claim 6, wherein the breather holes are located in both the top air mattress and the base air mattress.

8. The airbag system of claim 6, wherein the tubular posts are separated from each other by a distance that is greater than twice the common diameter of the tubular posts.

9. The airbag system of claim 6, further comprising a third air mattress operably supported upon the top air mattress by a second plurality of tubular posts.

10. An airbag system comprising:

a base air mattress capable of sustaining an air pressure;

a top air mattress capable of sustaining an air pressure;

a plurality of tubular posts positioned between the base air mattress and the top air mattress in a generally vertical orientation so that the top air mattress is supported upon the base air mattress;

a plurality of breather holes in the top air mattress and a plurality of breather holes in the base air mattress, wherein each of the tubular posts is sealably mounted around at least one of the breather holes of the base air mattress, and at least one of the breather holes of the top air mattress, to permit airflow from both the base air mattress and the top air mattress into the corresponding tubular post, but there is no airflow between the tubular posts except via the base air mattress and the top air mattress; and wherein the tubular posts all have a common diameter, and the tubular posts are separated from each other by a distance that is greater than the common diameter of the tubular posts.

11. The airbag system of claim 10, wherein the tubular posts are separated from each other by a distance that is greater than twice the common diameter of the tubular posts.

12. The airbag system of claim 10, further comprising a third air mattress operably supported upon the top air mattress by a second plurality of tubular posts.

* * * * *